US009164527B2

(12) United States Patent
Huang

(10) Patent No.: US 9,164,527 B2
(45) Date of Patent: Oct. 20, 2015

(54) LOW-VOLTAGE BAND-GAP VOLTAGE REFERENCE CIRCUIT

(71) Applicant: Fairchild Semiconductor Corporation, San Jose, CA (US)

(72) Inventor: Lei Huang, Beijing (CN)

(73) Assignee: Fairchild Semiconductor Corporation, San Jose, CA (US)

( * ) Notice: Subject to any disclaimer, the term of this patent is extended or adjusted under 35 U.S.C. 154(b) by 155 days.

(21) Appl. No.: 13/890,727

(22) Filed: May 9, 2013

(65) Prior Publication Data

US 2013/0307517 A1 Nov. 21, 2013

(30) Foreign Application Priority Data

May 9, 2012 (CN) ..... 2012 1 0148468

(51) Int. Cl.
*G05F 3/04* (2006.01)
*G05F 3/02* (2006.01)

(52) U.S. Cl.
CPC ..... *G05F 3/02* (2013.01)

(58) Field of Classification Search
CPC ..... H03K 3/011; H03K 3/354; G05F 3/30; G05F 3/262; G05F 1/565; G05F 1/575
USPC ..... 327/52–55, 356, 359, 512, 513, 539; 323/311–316
See application file for complete search history.

(56) References Cited

U.S. PATENT DOCUMENTS

| | | | | |
|---|---|---|---|---|
| 6,114,843 | A * | 9/2000 | Olah | 323/280 |
| 6,529,066 | B1 | 3/2003 | Guenot et al. | |
| 6,677,808 | B1 | 1/2004 | Sean et al. | |
| 6,946,825 | B2 * | 9/2005 | Tesi | 323/313 |
| 7,170,336 | B2 * | 1/2007 | Hsu | 327/539 |
| 7,199,646 | B1 * | 4/2007 | Zupcau et al. | 327/539 |
| 7,342,390 | B2 * | 3/2008 | Tachibana et al. | 323/316 |
| 7,777,558 | B2 * | 8/2010 | Chen | 327/539 |

FOREIGN PATENT DOCUMENTS

| | | |
|---|---|---|
| CN | 101980097 A | 2/2011 |
| CN | 202711108 U | 1/2013 |

OTHER PUBLICATIONS

"Chinese Application Serial No. 201210148468.6, Office Action mailed Oct. 21, 2014", 9 pgs.

(Continued)

*Primary Examiner* — Rajnikant Patel
(74) *Attorney, Agent, or Firm* — Schwegman Lundberg & Woessner, P.A.

(57) ABSTRACT

The present application discusses low voltage band-gap voltage reference circuit and methods. In an example the circuit can include a current mirror, an operational amplifier adopting an N-Metal-Oxide-Semiconductor (NMOS) input pair structure, a band-gap output circuit, an adaptive adjustment circuit; and two branches of Bipolar Junction Transistor (BJT). The current mirror can be configured to receive an output signal of the operational amplifier and to provide a current to the two branches of BJT. The operational amplifier can be configured to differentially input voltages at the upper ends of the two branches of BJT, to generate the output signal to the current mirror, and to equalize the voltages at the upper ends of the two branches of BJT using a deep negative feedback.

20 Claims, 7 Drawing Sheets

(56) References Cited

OTHER PUBLICATIONS

Hua, Si-Liang, et al., "A Sub-1-V CMOS Bandgap Voltage Reference for A/D Converter", Microelectronic & Computer, vol. 25, No. 7, (Jul. 31, 2008), 210-213.

Huang, Yu-Quan, et al., "Design of a Bandgap Reference with 1.5V Supply Voltage", China Academic Journal Electronic Publishing House, (Dec. 31, 2007), 95-98.

* cited by examiner

LOW-VOLTAGE BAND-GAP VOLTAGE REFERENCE CIRCUIT

CLAIM OF PRIORITY

This application claims the benefit of priority under 35 U.S.C. 119 to Chinese Patent Application Number 201210148468.6, filed May 9, 2012, which is hereby incorporated by reference herein in its entirety.

BACKGROUND

Voltage reference circuits, such as band-gap voltage references, are widely used top provide reference voltages for other circuits such as digital-to-analog converters (DACs), analog-to-digital converters (ADCs), memory circuits and other circuits.

OVERVIEW

The present disclosure discusses low voltage band-gap voltage reference circuits and methods. In an example the circuit can include a current mirror, an operational amplifier adopting an N-Metal-Oxide-Semiconductor (NMOS) input pair structure, a band-gap output circuit, an adaptive adjustment circuit; and two branches of Bipolar Junction Transistor (BJT). The current mirror can be configured to receive an output signal of the operational amplifier and to provide a current to the two branches of BJT. The operational amplifier can be configured to differentially input voltages at the upper ends of the two branches of BJT, to generate the output signal to the current mirror, and to equalize the voltages at the upper ends of the two branches of BJT using a deep negative feedback. The adaptive adjustment circuit can be configured to adaptively adjust a base voltage of common base BJTs in the two branches of BJT according to an operating condition of an NMOS input pair in the operational amplifier. The two branches of BJT can be configured to control respective current of the two branches of BJT according to the base voltage of the common base BJTs to ensure normal operation of the operational amplifier. The band-gap output circuit can be configured to generate an output voltage of the low-voltage band-gap voltage reference circuit by mirroring.

This overview is intended to provide a general overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
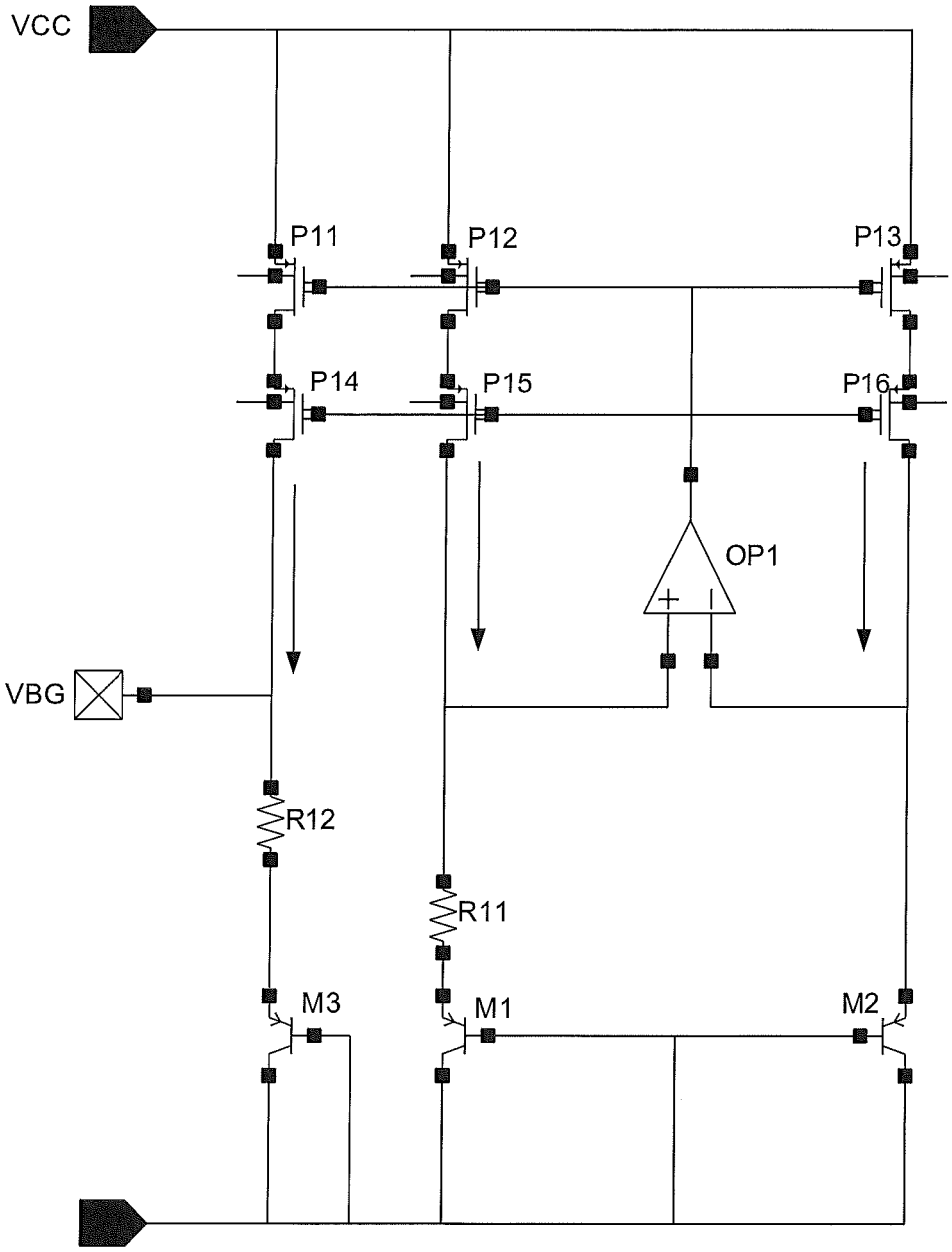
FIG. 1 (PRIOR ART)
FIGS. 1 and 2 illustrate existing bandgap voltage reference circuit structures.
Figure 2:
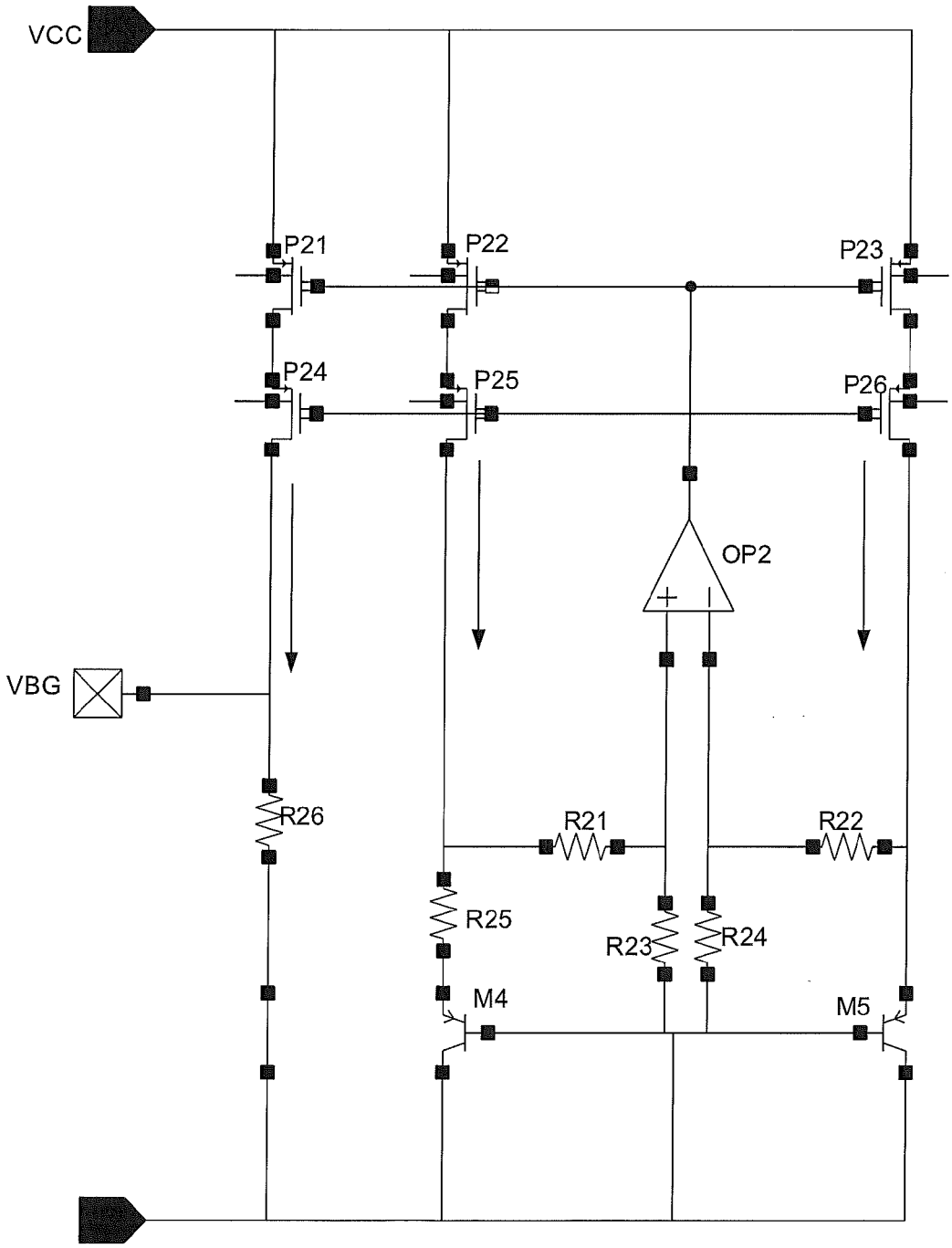
FIG. 2 (PRIOR ART)

Existing band-gap voltage reference circuit can have structures as shown in FIG. 1 and FIG. 2. FIG. 1 illustrates P-Metal-Oxide-Semiconductor transistors (PMOS) P11, PMOS P12, PMOS P13 that form a cascode current mirror for mirroring a current on the circuit of each other. PMOS P14, PMOS P15, PMOS P16 form a cascode circuit. The positive input of the operational amplifier OP1 is connected to the drain of PMOS P15 and to one end of the resistor R11, and the negative input of OP1 is connected to the drain of PMOS P16 and to the emitter of PNP M2. The output of OP1 is connected to the gate of PMOS P12 and the gate of PMOS P13, and the other end of resistor R11 is connected to the emitter of PNP M1. The base of PNP M1 and the base of PNP M2 are connected to the ground. Both the collectors of PNP M1 and PNP M2 are connected to the ground. The drain of PMOS P14 serves as an output, with an output voltage VBG, and the drain of PMOS P14 is connected to one end of resistor R12. The other end of resistor R12 is connected to the emitter of PNP M3, both the base and the collector of PNP M3 are connected to the ground. With the bandgap voltage reference circuit shown in FIG. 1, voltages at the positive and negative inputs of OP1 are the same. PNP M2 is typically formed by multiple PNPs connected in parallel. Operational amplifier OP1 adopts a PMOS input pair structure. The minimal input voltage required for normal operation of OP1 will be $VCC=|Vbe|+|Vgs|+|Vds|$, wherein $|Vbe|$ is the emitter-base voltage of PNP M2, $|Vgs|$ is the source-gate voltage of the PMOS input pair in OP1, and $|Vds|$ is source-drain voltage of the PMOS input pair in OP1. Since the voltage $|Vgs|$ is large, the voltage VCC is thus large, typically with a minimal value of at least about 2V.

FIG. 2 illustrates PMOS P21, PMOS P22, PMOS P23 forming a cascode current mirror for mirroring a current on the circuit of each other. PMOS P24, PMOS P25, and PMOS P26 form a cascode circuit. The positive input of the operational amplifier OP2 is connected to the base of PNP M4 and the base of PNP M5 via resistor R23, and to the drain of PMOS P25 via resistor R21. The negative input of OP2 is connected to the base of PNP M4 and the base of PNP M5 via resistor R24, and to the drain of PMOS P26 and the emitter of PNP M5 via resistor R22. The output of OP2 is connected to the gates of PMOS P22 and PMOS P23. One end of resistor R25 is connected to the drain of PMOS P25. The other end of resistor R25 is connected to the emitter of PNP M4. The base of PNP M4 is and the base of PNP M5 are connected to the ground. Both collectors of PNP M4 and PNP M5 are connected to ground. The drain of PMOS P24 serves as an output, with an output voltage VBG, and the drain of PMOS P24 is connected to one end of resistor R26. The other end of resistor R26 is connected to the ground. With the bandgap voltage reference circuit shown in FIG. 2, voltages at the positive and negative inputs of OP2 are the same, the ratio of resistances of resistors R21 and R23 is equal to that of resistors R22 and R24. For example, resistor R21 may be formed by two resistors R22 connected in series, and resistor R23 may be formed by two resistors R24 connected in series, etc. OP2 can adopt a PMOS input pair structure. The minimal input voltage required for normal operation of OP2 is low. However, due to the existence of resistors R21 and R22, the offset of OP2 is amplified, which is disadvantageous for the application.

In certain examples, voltages at the upper ends of two branches of BJT can be differentially input to an operational amplifier adopting an NMOS input pair structure. Output of the operational amplifier can be connected to a current mirror. The voltages at the upper ends of the two branches of BJT can be equalized using a deep negative feedback. Base voltage of common base BJTs in the two branches of BJT can be adaptively adjusted according to the operating condition of the NMOS input pair in the operational amplifier to control respective current of the two branches of BJT, thereby ensuring the operational amplifier operates normally.

Figure 3:
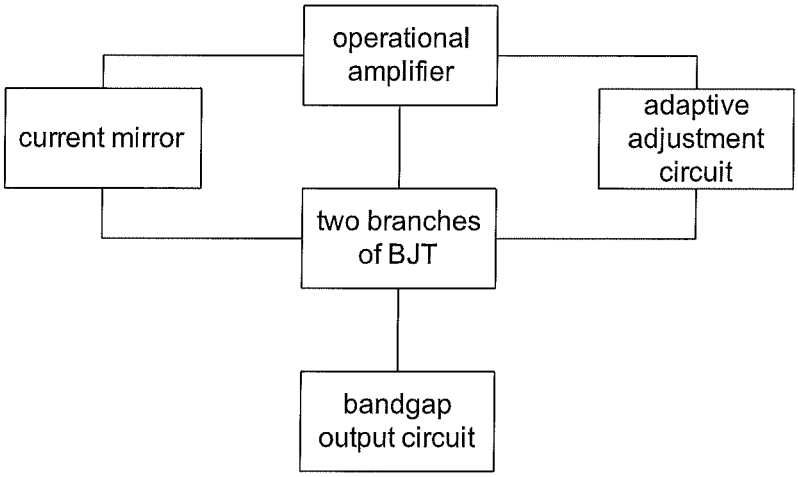
FIG. 3 illustrates generally an example low-voltage band-gap voltage reference circuit.

FIG. 3 illustrates generally and example low-voltage, band-gap voltage circuit. In an example, the low-voltage, band-gap voltage circuit can include a current mirror, an operational amplifier adopting an NMOS input pair structure, a band-gap output circuit, an adaptive adjustment circuit and two branches of BJT. In certain examples, the current mirror can be configured to receive an output signal of the operational amplifier and provide a current to the two branches of BJT. In some examples, the operational amplifier can be configured to differentially input voltages at the upper ends of the two branches of BJT, to transmit the output signal to the current mirror, and to equalize the voltages at the upper ends of the two branches of BJT using a deep negative feedback. In certain examples, the adaptive adjustment circuit can be configured to adaptively adjust a base voltage of common base BJTs in the two branches of BJT according to an operating condition of an NMOS input pair in the operational amplifier. In some examples, the two branches of BJT can be configured to control respective current of the two branches of BJT according to the base voltage of the common base BJTs, to ensure the operational amplifier to operates normally. In certain examples, the band-gap output circuit can be configured to generate an output voltage of the band-gap voltage reference circuit by mirroring. In certain examples, the common base BJTs can be common base PNPs.

Figure 4:
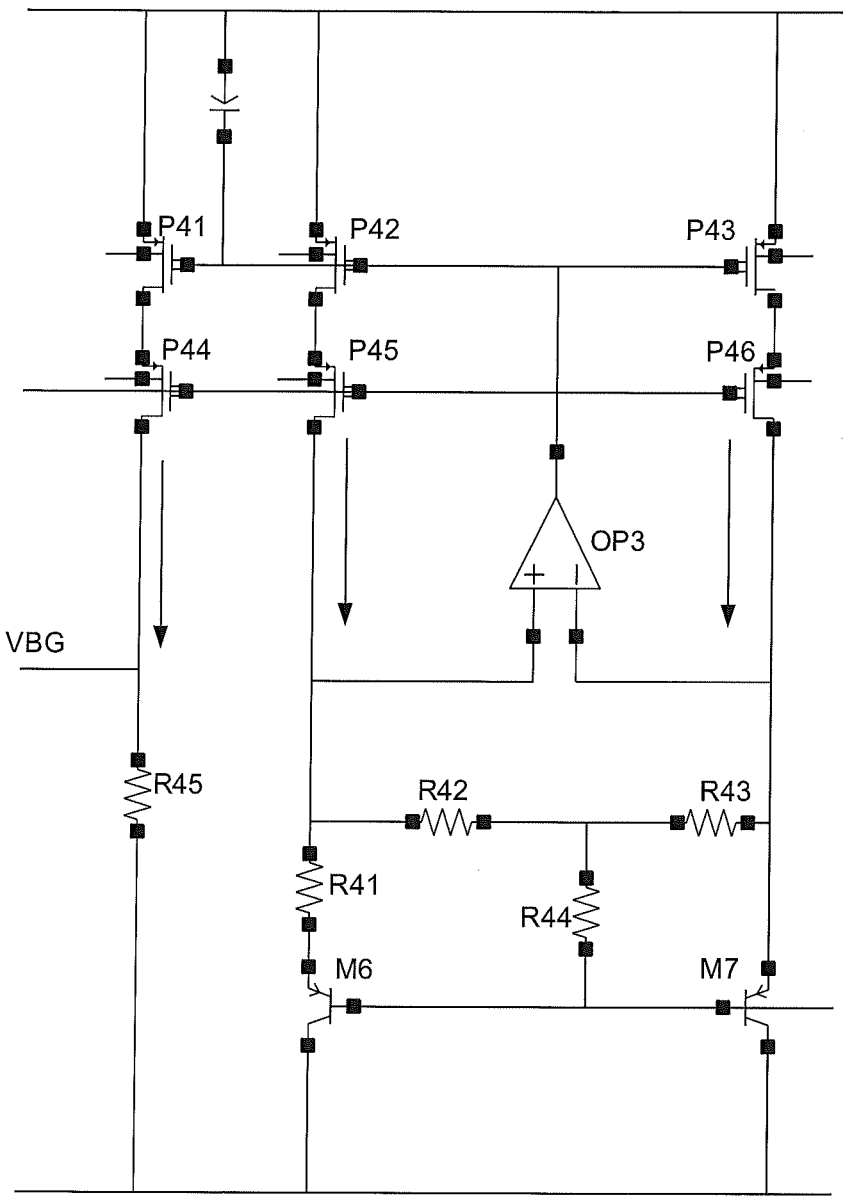
FIG. 4 illustrates generally an example low-voltage band-gap voltage reference circuit.

FIG. 4 illustrates generally an example band-gap voltage reference circuit, in which the adaptive adjustment circuit is not shown. The current mirror can be formed by cascode PMOS P42 and PMOS P43. A left branch of the two branches of BJT can include resistor R41 and PNP M6, wherein one end of resistor R41 is connected to the positive input of operational amplifier OP3, and the other end of resistor R41 is connected to the emitter of PNP M6. The collector of PNP M6 can be connected to ground, and the base of PNP M6 can be connected to the base of PNP M7 of the right branch. The emitter of PNP M7 can be connected to the negative input of OP3, and the collector of PNP M7 can be connected to ground. The operational amplifier OP3 can adopt an NMOS input pair structure, with the positive and negative inputs connected to the two branches of BJT, respectively, and the output of the operational amplifier OP3 can be connected to the gate of PMOS P42 and the gate of PMOS P43. In certain examples, resistors R42 and R43 can be connected in series between the positive and negative inputs of the operational amplifier OP3. One end of resistor R44 can be connected between resistors R42 and R43, and the other end of resistor R44 can be connected to the base of PNP M6 and the base of PNP M7. In some examples, the band-gap output circuit can include PMOS P41 and resistor R45, wherein PMOS P41 is in cascode connection with PMOS P42, to mirror the current of the left branch. Current can pass through resistor R45 and can generate the output voltage VBG of the band-gap voltage reference circuit.

The voltages of the positive and negative inputs of the operational amplifier OP3 in FIG. 4 can be equal and can be equal to the emitter-base voltage |Vbe| of PNP M7. The voltage on resistor R41 of the left branch can be equal to the emitter-base voltage of PNP M7 minus the emitter-base voltage of PNP M6, which is d|Vbe|. The current on resistor R41 of the left branch is I2=d|Vbe|/R41, the current on resistor R42 is I3=|Vbe|/(R42+(1+1/a)*R44), the current of the band-gap output circuit I1=I2+I3, and the output voltage VBG=I1*R45, wherein "a" is the ratio of the currents on resistors R42 and R43. In certain examples, I2 can provide a positive temperature coefficient, I3 can provide a negative temperature coefficient, and a temperature-independent output voltage VBG can be obtained by adjusting the ratio of the resistances of resistors R41 to R44.

PMOS P44, PMOS P45 and PMOS P46 as illustrated in the example of FIG. 4 can serve as a cascode circuit for increasing the output impedance.

Figure 5:
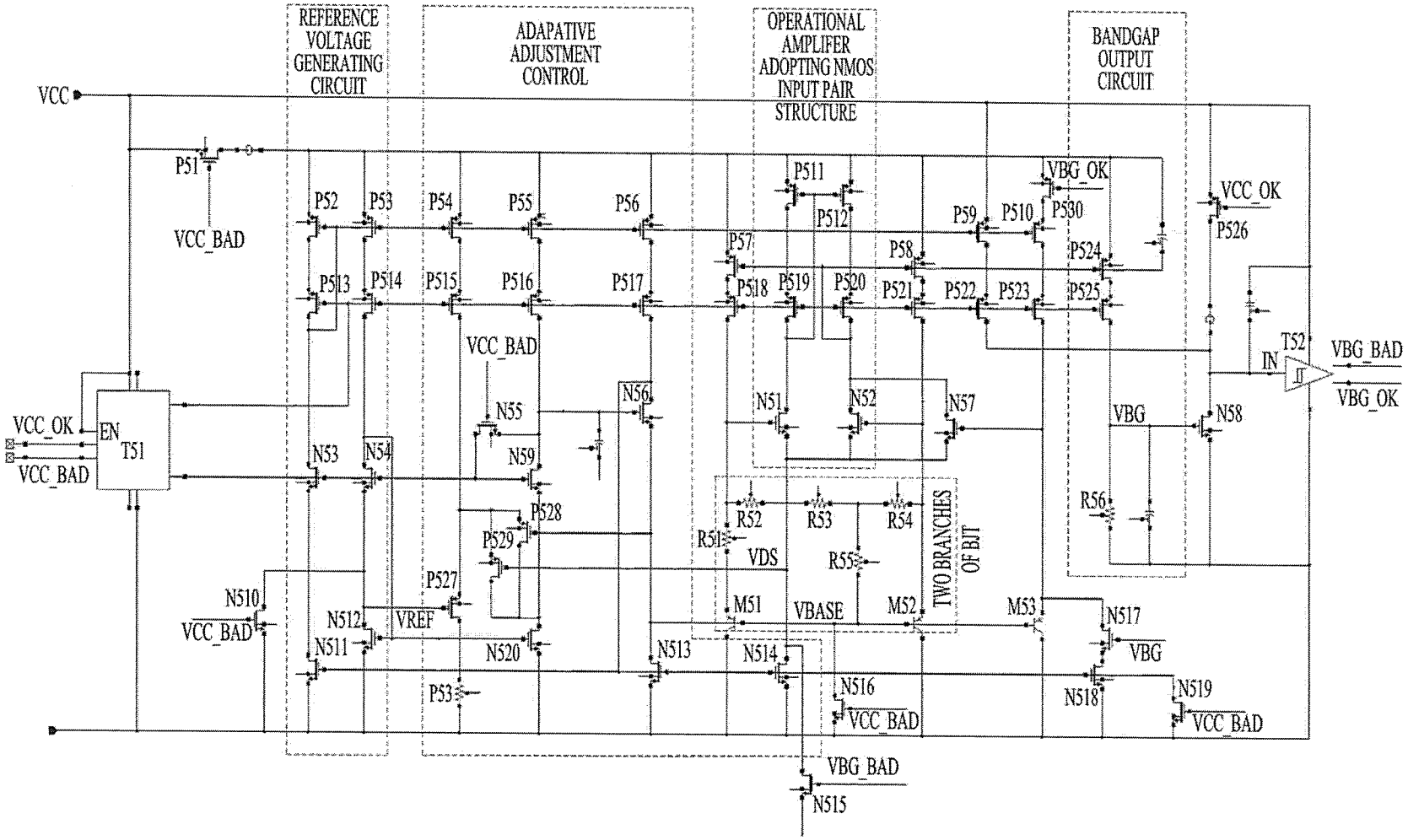
FIG. 5 illustrates generally an example low-voltage band-gap voltage reference circuit.

FIG. 5 illustrates generally an example band-gap voltage reference circuit. The band-gap voltage reference circuit can include an operational amplifier adopting an NMOS input pair structure that can be formed by PMOS P511, PMOS P512, PMOS P519, PMOS P520, NMOS N51, and NMOS N51N52, wherein PMOS P511 and PMOS P511 P512 are in cascode connection. PMOS P519 and PMOS P520 can serve as a cascode circuit and can be connected to the drains of PMOS P511 and PMOS P512, respectively. The gate of NMOS N51 can be connected to the left branch of the two branches of BJT, the drain of NMOS N51 can be connected to the drain of PMOS P519, and the source of NMOS N51 can serve as a feedback end and can be connected to the adaptive adjustment circuit and to the source of NMOS N52. The gate of NMOS N52 can be connected to the right branch of the two branches of BJT, the drain of NMOS N52 can serve as an output end and can be connected to the current mirror and to the drain of PMOS P520. The source of PMOS P520 can be connected to of the source of NMOS N52. In certain examples, band-gap voltage reference circuit can include PMOS P519 and PMOS P520. When P519 and P520 are not in use, the source and drain of PMOS P519 and PMOS P520 can be substantially short circuited.

The current mirror configured to receive the output signal of the operational amplifier can be formed by PMOS P57, PMOS P58, PMOS P518, and PMOS P521, wherein PMOS P57 and PMOS P58 are in cascode connection. The gate of PMOS P57 and the gate of PMOS P58 can be connected to the drain of NMOS N52. In certain examples, PMOS P518 and PMOS P521 are optional. When PMOS P518 and PMOS P521 are not in use, the source and drain of PMOS P518 and PMOS P521 can be substantially short circuited.

In certain examples, the band-gap output circuit can be formed by PMOS P524, PMOS P525 and resistor R56, wherein PMOS P524 is in cascode connection with PMOS P511. PMOS P512 and PMOS P525 can serve as a cascode circuit. PMOS 525 can be connected to the drain of PMOS P524. The drain of PMOS P525 can output the output voltage VBG of the bandgap voltage reference circuit, and can be connected to resistor R56. In certain example, PMOS P525 is optional. When PMOS P525 is not in use, the source and drain of P525 can be substantially short-circuited.

In certain examples, the adaptive adjustment circuit can be formed by PMOS P54, PMOS P55, PMOS P56, PMOS P515, PMOS P516, PMOS P517, PMOS P527, PMOS P528, PMOS P529, NMOS N56, NMOS N59, NMOS N513, NMOS N514, and NMOS N520, wherein PMOS P54, PMOS P55, and PMOS P56 are in cascode connection. PMOS P515, PMOS P516, and PMOS P517 can be connected as a cascode circuit to the drains of PMOS P54, PMOS P55, and PMOS P56, respectively. The source of PMOS P527 can be connected to the drain of PMOS P515 and to the sources of PMOS P528 and PMOS P529. The drain of PMOS P527 is connected to the ground via resistor R57 and the gate of PMOS P527 is connected to the reference voltage VREF. The gate of PMOS P528 can be connected to the source of NMOS N56 and the drain of NMOS N513. The drain of PMOS P528 can be connected together with the drain of PMOS P529, the source of NMOS N59, and the drain of NMOS N520. The gate of PMOS P529 can be connected to the sources of NMOS N51 and NMOS N52, and to the drain of NMOS N514. The sources of both NMOS N514 and NMOS N520 can be connected to ground. The gates of both NMOS N514 and NMOS N520 can be connected to a drive voltage. The gate of NMOS N56 and the drain of NMOS N59 can be connected together. The source of NMOS N56 can be connected to the base of the common base BJTs in the two branches of BJT. In certain examples, PMOS P515, PMOS P516, PMOS P517 are optional, and when they are not in use, the sources and drains of PMOS P515, PMOS P516, PMOS P517 are substantially short-circuited.

In certain examples, the two branches of BJT can be formed by resistor R51, resistor R52, resistor R53, resistor R54, resistor R55, PNP M51, and PNP M52. The base of PNP M51 and the base of PNP M52 can be connected together to the gate of PMOS P528 and the source of NMOS N56, and not to the ground.

In certain examples, the sum of the currents on PMOS P528, PMOS P529 of the adaptive adjustment circuit in the example of FIG. 5 can be equal to the current on PMOS P527. When the source voltage of NMOS N51 and NMOS N52 of the operational amplifier becomes low, the current on NMOS N56 can be adjusted to a larger value, pulling up the base voltage of PNP M51, PNP M52 in the two branches of BJT. After the base voltage of PNP M51, PNP M52 is pulled up, the current in the two branches of BJT can increase, pulling up the source voltage of NMOS N51 and NMOS N52 of the operational amplifier. When the source voltage of NMOS N51 and NMOS N52 of the operational amplifier becomes high, the current on NMOS N56 can be adjusted to a smaller value, pulling down the base voltage of PNP M51, PNP M52 in the two branches of BJT. After the base voltage of PNP M51, PNP M52 is pulled down, current in the two branches of BJT can decrease, pulling down the source voltage of NMOS N51 and NMOS N52 of the operational amplifier. Therefore, the normal operation of the operational amplifier can be ensured. Inn certain examples, the source voltage of the NMOS N51 and NMOS N52 becomes higher or lower with respect to that when the operational amplifier operates normally, which voltage is set according to a practical application.

In the example band-gap voltage reference circuit as illustrated in FIG. 5, the minimal input voltage required by the normal operation of the operational amplifier is VCC=VBASE+|Vbe|+|Vds|, wherein VBASE is the base voltage of common base BJTs in the two branches of BJT, |Vbe| is the emitter-base voltage of PNP M52, |Vds| is the drain-source voltage of NMOS N51 and NMOS N52. Since the voltage VBASE is low, the minimal input voltage required, voltage VCC, may typically be about 1.2V. Further, since the positive and negative inputs of the operational amplifier are connected to the two branches of BJT directly, thus the offset of operational amplifier will not be amplified.

The example band-gap voltage reference circuit of FIG. 5 can further include an offset current source chip T51 configured to provide PMOS gate driving voltage and NMOS gate driving voltage.

The offset current source chip T51 can be configured to detect whether input voltage VCC is normal, and output an input-voltage-VCC-normal signal VCC_OK or an input-voltage-VCC-abnormal signal VCC_BAD.

The example band-gap voltage reference circuit of FIG. 5 can include an input protecting circuit configured to turn on or off the band-gap voltage reference circuit according to the input-voltage-VCC-normal signal VCC_OK or the input-voltage-VCC-abnormal signal VCC_BAD. PMOS P51, PMOS P526, NMOS N55, NMOS N510, NMOS N516, and NMOS N519 as shown in FIG. 5 can form the input protecting circuit.

In certain examples, the band-gap voltage reference circuit of FIG. 5 can include an output protecting circuit configured to generate an output-normal signal VBG_OK or output-abnormal signal VBG_BAD according to the fact of whether there is an output voltage, and can turn on or off the band-gap voltage reference circuit according to the output-normal signal VBG_OK or the output-abnormal signal VBG_BAD. PMOS P530, NMOS N58, NMOS N515, and inverter T2 as shown in the example of FIG. 5 can form the output protecting circuit.

In certain examples, the band-gap voltage reference circuit Of FIG. 5 can include a reference voltage generating circuit configured to provide the adaptive adjustment circuit with the reference voltage VREF.

In certain examples, the band-gap voltage reference circuit Of FIG. 5 can include a start-up circuit configured to pull down the output voltage of the operational amplifier during power-on, to make the operational amplifier start up rapidly, and to stop pulling down the output voltage of the operational amplifier when there is an output voltage. PNP M53, NMOS N57, NMOS N517, and NMOS N518 as shown in FIG. 5 can form the start-up circuit.

Figure 6:
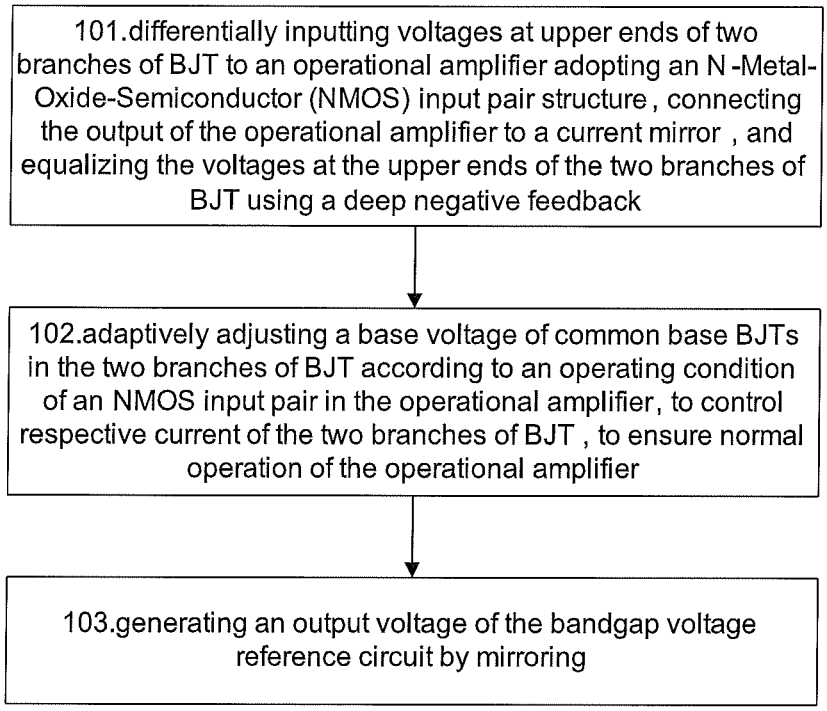
FIG. 6 illustrates generally an example method for implementing a low voltage band-gap voltage reference circuit.

FIG. 6 illustrates generally an example method for implementing a low voltage band-gap voltage reference circuit. In certain examples, the method can include, at 101, differentially inputting voltages at the upper ends of two branches of BJT to an operational amplifier adopting an NMOS input pair structure, and equalizing the voltages at the upper ends of the two branches of BJT using a deep negative feedback, wherein the output of the operational amplifier is connected to a current mirror.

At 102, adaptively adjusting the base voltage of the common base BJTs in the two branches of BJT according to the operating condition of the NMOS input pair in the operational amplifier to control respective current of the two branches of BJT, thereby ensuring the normal operation of the operational amplifier.

In certain examples, when a source voltage of the NMOS input pair in the operational amplifier becomes low, the base voltage of the common base BJTs in the two branches of BJT is pulled up, and the source voltage of the NMOS input pair of the operational amplifier is pulled up. When the source voltage of the NMOS input pair of the operational amplifier becomes high, the base voltage of the common base BJTs in the two branches of BJT is pulled down, and the source voltage of the NMOS input pair of the operational amplifier is pulled down.

In some examples, the common base BJTs can include common base PNPs.

At 103, generating the output voltage of the bandgap voltage reference circuit by mirroring.

For example, the current of the branch which has a connected in serial resistor can be mirrored, and the output voltage of the bandgap voltage reference circuit can be generated through a voltage dividing resistor.

In certain examples, the aforementioned method can include detecting whether the input voltage is normal, and outputting an input-voltage-normal signal or input-voltage-abnormal signal.

In certain examples, the aforementioned method can include turning on or off the band-gap voltage reference circuit according to the input-voltage-normal signal or the input-voltage-abnormal signal.

In certain examples, the aforementioned method can include generating an output-normal signal or output-abnormal signal according to the fact of whether there is an output voltage, and turning on or off the band-gap voltage reference circuit according to the output-normal signal or the output-abnormal signal.

Figure 7:
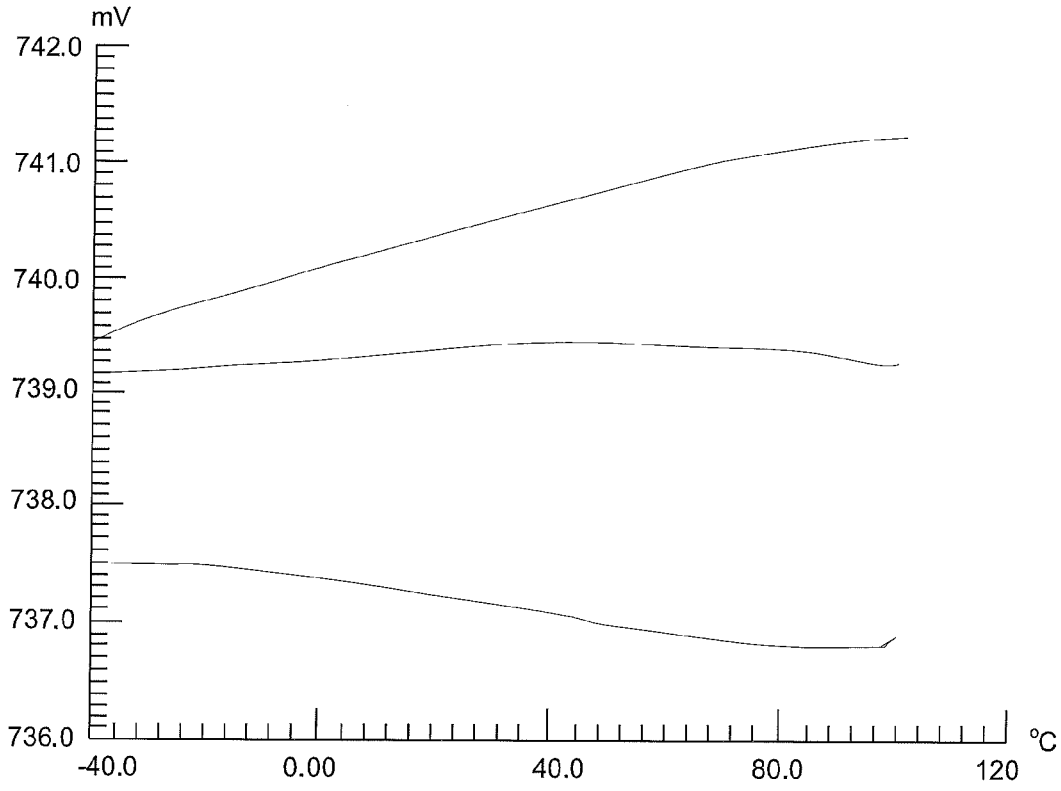
FIG. 7 illustrates measurement results of output voltage variation over temperature according to example low-voltage band-gap voltage reference circuits.

FIG. 7 illustrates the result of three measurements of the variation of the output voltage over temperature according to the band-gap voltage reference circuit of an embodiment of the present disclosure, wherein each curve stands for one measurement, and it can be seen that when the temperature is between −40° C. to 100° C., variation in the output voltage of the band-gap voltage reference circuit is not greater than 2 mV.

Additional Notes

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A low-voltage band-gap voltage reference circuit, comprising:

a current mirror;

an operational amplifier adopting an N-Metal-Oxide-Semiconductor (NMOS) input pair structure;

a bandgap output circuit;

an adaptive adjustment circuit;

two branches of Bipolar Junction Transistor (BJT), and a resistor network;

wherein the current mirror is configured to receive an output signal of the operational amplifier and to provide a current to the two branches of BJT;

wherein the operational amplifier is configured to differentially input voltages at the upper ends of the two branches of BJT, to generate the output signal to the current mirror, and to equalize the voltages at the upper ends of the two branches of BJT using a deep negative feedback;

wherein the adaptive adjustment circuit is configured to adaptively adjust a base voltage of common base BJTs in the two branches of BJT according to an operating condition of an NMOS input pair in the operational amplifier;

wherein the two branches of BJT are configured to control respective current of the two branches of BJT according to the base voltage of the common base BJTs to ensure normal operation of the operational amplifier;

wherein a first branch of the two branches of BJT include a first resistor, wherein the resistor network includes:

a second resistor, a third resistor, and a fourth resistor, wherein the second and third resistor are coupled in series between the upper ends of the two branches of BJT, wherein the fourth resistor is coupled between a first node common to both the second and third resistors and a second node providing the base voltage of the common base BJTs in the two branches of BJT;

wherein the band-gap output circuit is configured to generate an output voltage of the low-voltage band-gap voltage reference circuit by mirroring; and wherein the output voltage of the low-voltage band-gap voltage reference circuit can be adjusted using a ratio of the first resistor and the fourth resistor.

2. The band-gap voltage reference circuit according to claim 1, wherein the common base BJTs are common base PNPs.

3. The band-gap voltage reference circuit according to claim 2, wherein the operational amplifier adopting the NMOS input pair structure is formed by a first P-Metal-Oxide-Semiconductor (PMOS) transistor, a second PMOS transistor, a first NMOS transistor, and a second NMOS transistor;

wherein the first PMOS transistor and the second PMOS transistor are in cascode connection;

wherein the gate of the first NMOS transistor is connected to the left branch of the two branches of BJT;

wherein the drain of the first NMOS transistor is connected to the drain of the first PMOS transistor;

wherein the source of the first NMOS transistor, configured to serve as a feedback end, is connected to the adaptive adjustment circuit and to the source of the second NMOS transistor;

wherein the gate of the second NMOS transistor is connected to the right branch of the two branches of BJT;

wherein the drain of the second NMOS transistor, configured to serve as an output end, is connected to the current mirror and to the drain of the second PMOS transistor; and wherein the source of the second NMOS transistor is connected to the source of the first NMOS transistor.

4. The band-gap voltage reference circuit according to claim 3, wherein the current mirror is formed by a third PMOS transistor and a fourth PMOS transistor;

wherein the third PMOS transistor and the fourth PMOS transistor are in cascode connection, wherein the gates of the third PMOS transistor and the fourth PMOS transistor are connected to the drain of the second NMOS transistor; and wherein the drains of the third PMOS transistor and the fourth PMOS transistor are connected to the two branches of BJT, respectively.

5. The band-gap voltage reference circuit according to claim 4, wherein the band-gap output circuit is formed by a fifth PMOS transistor and a fifth resistor;

wherein the fifth PMOS transistor is in cascode connection with the first PMOS transistor and the second PMOS transistor; and wherein the drain of the fifth PMOS transistor is configured to output the output voltage of the band-gap voltage reference circuit and is connected to the fifth resistor.

6. The band-gap voltage reference circuit according to claim 5, wherein the adaptive adjustment circuit is formed by a first adjustment PMOS transistor, a second adjustment PMOS transistor, a third adjustment PMOS transistor, a fourth adjustment PMOS transistor, a fifth adjustment PMOS transistor, a sixth adjustment PMOS transistor and a first adjustment NMOS transistor, a second adjustment NMOS transistor, a third adjustment NMOS transistor, a fifth adjustment NMOS transistor, and a sixth adjustment NMOS transistor, wherein the first adjustment PMOS transistor, the second adjustment PMOS transistor, and the third adjustment PMOS transistor are in cascode connection;

wherein the source of the fourth adjustment PMOS transistor is connected to the drain of the first adjustment PMOS transistor and to the sources of the fifth adjustment PMOS transistor and the sixth adjustment PMOS transistor;

wherein the drain of the fourth adjustment PMOS transistor is connected to ground via a sixth resistor;

wherein the gate of the fourth adjustment PMOS transistor is connected to a reference voltage;

wherein the gate of the fifth adjustment PMOS transistor is connected to the source of the first adjustment NMOS transistor and the drain of the third adjustment NMOS transistor;

wherein the drain of the fifth adjustment PMOS transistor is connected to the drain of the sixth adjustment PMOS transistor, to the source of the second adjustment NMOS transistor, and to the drain of the sixth adjustment NMOS transistor;

wherein the gate of the sixth adjustment PMOS transistor is connected to the sources of the first NMOS transistor and the second NMOS transistor, and to the drain of the fifth adjustment NMOS transistor;

wherein the sources of the fifth adjustment NMOS transistor and sixth adjustment NMOS transistor are connected to ground, wherein the gates of the fifth adjustment NMOS transistor and sixth adjustment NMOS transistor are connected to a drive voltage;

wherein the gate of the first adjustment NMOS transistor and the drain of the second adjustment NMOS transistor are connected together; and wherein the source of the first adjustment NMOS transistor is connected to the base of the common base BJTs in the two branches of BJT.

7. The band-gap voltage reference circuit according to claim 6, wherein at least one of the operational amplifier, the current mirror, the bandgap output circuit or the adaptive adjustment circuit includes a cascode circuit.

8. The band-gap voltage reference circuit according to claim 6, wherein the two branches of BJT is formed by the first resistor, a first BJT and a second BJT; and wherein the bases of the first BJT and the second BJT are connected together to the gate of the fifth adjustment PMOS transistor and the source of the first adjustment NMOS transistor, and not to the ground.

9. The band-gap voltage reference circuit according to claim 8, wherein a sum of the currents on the fifth adjustment PMOS transistor and the sixth adjustment PMOS transistor of the adaptive adjustment circuit is equal to the current on the fourth adjustment PMOS transistor;

wherein, when a source voltage of the first NMOS transistor and the second NMOS transistor of the operational amplifier becomes low, the current on the first adjustment NMOS transistor is configured to adjust to a larger value and the base voltage of the common base BJTs in the two branches of BJT is configured to pull up;

wherein, after the base voltage is pulled up, the current in the two branches of BJT is configured to increase and to pull up the source voltage of the first NMOS transistor and the second NMOS transistor of the operational amplifier;

wherein, when the source voltage of the first NMOS transistor and the second NMOS transistor of the operational amplifier becomes high, the current on the first adjustment NMOS transistor is configured to adjust to a smaller value and to pull down the base voltage of the common base BJTs in the two branches of BJT; and wherein, after the base voltage is pulled down, the current in the two branches of BJT is configured to decrease and to pull down the source voltage of the first NMOS transistor and the second NMOS transistor of the operational amplifier.

10. The band-gap voltage reference circuit according to claim 9, including an offset current source chip configured to detect whether an input voltage is normal and to output an input-voltage-normal signal if the input voltage is normal or an input-voltage-abnormal signal if the input signal is abnormal.

11. The band-gap voltage reference circuit according to claim 10, including an input protecting circuit configured to turn on or off the bandgap voltage reference circuit according to the input-voltage-normal signal or the input-voltage-abnormal signal.

12. The band-gap voltage reference circuit according to claim 11 including an output protecting circuit configured to generate an output-normal signal or an output-abnormal signal according to whether there is the output voltage, and to turn on or off the band-gap voltage reference circuit according to the output-normal signal or the output-abnormal signal.

13. The bandgap voltage reference circuit according to claim 12, including a reference voltage generating circuit configured to provide the adaptive adjustment circuit with the reference voltage.

14. The bandgap voltage reference circuit according to claim 13, including a start-up circuit configured to pull down the output voltage of the operational amplifier during power-on, to start up the operational amplifier rapidly, and to stop pulling down the output voltage of the operational amplifier when there is the output voltage.

15. A method for implementing a low-voltage band-gap voltage reference circuit, the method comprising:

differentially inputting voltages at upper ends of two branches of BJT to an operational amplifier adopting an N-Metal-Oxide-Semiconductor (NMOS) input pair structure, connecting the output of the operational amplifier to a current mirror, and equalizing the voltages at the upper ends of the two branches of BJT using a deep negative feedback;

adaptively adjusting a base voltage of common base BJTs in the two branches of BJT according to an operating condition of an NMOS input pair in the operational amplifier, to control respective current of the two branches of BJT, to ensure normal operation of the operational amplifier;

adjusting a ratio of a first resistor and a fourth resistor to set an output voltage of the low-voltage band-gap voltage reference circuit, wherein a first branch of the two branches of BJT include the first resistor, and wherein a resistor network coupled between the two branches of BJT includes the fourth resistor, the resistor network including:

a second resistor, a third resistor, and the fourth resistor, wherein the second and third resistor are coupled in series between the upper ends of the two branches of BJT, wherein the fourth resistor is coupled between a first node common to both the second and third resistors and a second node providing the base voltage of the common base BJTs in the two branches of BJT; and generating the output voltage of the bandgap voltage reference circuit by mirroring.

16. The method according to claim 15, wherein the adaptively adjusting a base voltage of common base BJTs in the two branches of BJT according to an operating condition of an NMOS input pair in the operational amplifier, to control respective current of the two branches of BJT, to ensure normal operation of the operational amplifier includes:

when a source voltage of the NMOS input pair in the operational amplifier becomes low, pulling up the base voltage of the common base BJTs in the two branches of BJT, and pulling up the source voltage of the NMOS input pair of the operational amplifier;

when the source voltage of the NMOS input pair in the operational amplifier becomes high, pulling down the base voltage of the common base BJTs in the two branches of BJT, and pulling down the source voltage of the NMOS input pair of the operational amplifier.

17. The method according to claim 16, wherein the common base BJTs are common base PNPs.

18. The method according to claim 17, including detecting whether an input voltage is normal, and outputting an input-voltage-normal signal or input-voltage-abnormal signal.

19. The method according to claim 18, including turning on or off the bandgap voltage reference circuit according to the input-voltage-normal signal or the input-voltage-abnormal signal.

20. The method according to claim 19, including generating an output-normal signal or an output-abnormal signal according to the fact of whether there is the output voltage, and turning on or off the bandgap voltage reference circuit according to the output-normal signal or the output-abnormal signal.

* * * * *